US006070037A

United States Patent [19]

Sugihara et al.

[11] Patent Number: 6,070,037

[45] Date of Patent: May 30, 2000

[54] IMAGE FORMING APPARATUS HAVING IMPROVED DEVELOPER LIMITING MEMBER

[75] Inventors: Kazuyuki Sugihara; Tomoji Ishikawa, both of Yokohama; Yoshiyuki Kimura, Tokyo; Kenji Maeda, Isehara, all of Japan

[73] Assignee: Ricoh Company, Ltd., Tokyo, Japan

[21] Appl. No.: 09/294,329

[22] Filed: Apr. 20, 1999

[30] Foreign Application Priority Data

| | | | |
|---|---|---|---|
| Apr. 20, 1998 | [JP] | Japan | 10-126868 |
| Jul. 24, 1998 | [JP] | Japan | 10-225302 |
| Feb. 24, 1999 | [JP] | Japan | 11-046109 |

[51] Int. Cl.[7] ..... G03G 15/08

[52] U.S. Cl. ..... 399/274; 399/103; 399/227

[58] Field of Search ..... 399/275, 274, 399/284, 267, 102, 103, 104, 105, 106, 227; 118/261

[56] References Cited

U.S. PATENT DOCUMENTS

| | | | |
|---|---|---|---|
| 5,084,733 | 1/1992 | Katoh et al. | 399/104 |
| 5,612,769 | 3/1997 | Sugihara et al. | 399/119 |
| 5,657,115 | 8/1997 | Sugihara | 399/263 |
| 5,671,470 | 9/1997 | Maruta et al. | 399/235 |
| 5,768,662 | 6/1998 | Sugihara et al. | 399/119 |
| 5,826,146 | 10/1998 | Maruta et al. | 399/235 |

FOREIGN PATENT DOCUMENTS

| | | |
|---|---|---|
| 62-192773 | 8/1987 | Japan . |
| 62-215973 | 9/1987 | Japan . |
| 2-025878 | 1/1990 | Japan . |
| 5-210307 | 8/1993 | Japan . |
| 8-022186 | 1/1996 | Japan . |
| 8-020747 | 3/1996 | Japan . |
| 8-146728 | 6/1996 | Japan . |
| 8-202153 | 8/1996 | Japan . |
| 8-234566 | 9/1996 | Japan . |
| 9-101676 | 4/1997 | Japan . |
| 9-185250 | 7/1997 | Japan . |
| 9-265238 | 10/1997 | Japan . |

*Primary Examiner*—Sophia S. Chen
*Attorney, Agent, or Firm*—Oblon, Spivak, McClelland, Maier & Neustadt, P.C.

[57] ABSTRACT

An image forming apparatus includes an image bearing member, a developing device to develop a latent image on a surface of the image bearing member, a developer bearing member including a magnet therein, which bears developer on a surface thereof by a magnetic force of the magnet and carries the developer towards a developing position facing the image bearing member by being rotated, a limiting member that is placed facing the developer bearing member so as to limit a thickness of a layer of the developer borne on the developer bearing member, and a developing device casing. The limiting member is provided with a magnetizable member having a protruding portion protruding toward the developer bearing member at a part that does not face the magnet and a recessed part at a part that faces the magnet, in which the magnetizable member is disposed upstream of the limiting member in a developer conveying direction of the developer bearing member and is placed such that the protruding portions are nearer to the surface of the developing roller than the limiting member and the recessed part is more distant from the surface of the developing roller than the limiting member. The limiting member is made of a non-magnetizable material.

10 Claims, 11 Drawing Sheets

IMAGE FORMING APPARATUS HAVING IMPROVED DEVELOPER LIMITING MEMBER

BACKGROUND OF THE INVENTION

1. Field of the Invention

The present invention relates to an image forming apparatus such as a copying machine, a facsimile, a printer, and the like, and more particularly to an image forming apparatus that develops a latent image on an image bearing member by a developing device including a developer bearing member to carry developer borne on a surface thereof by magnetic force of a magnet included therein to a position to develop the latent image on the image bearing member, a limiting member to limit a thickness of a layer of the developer on the developer bearing member and a developing device casing.

2. Discussion of the Background

In an image forming apparatus, it is known that magnetizable developer such as a two-component developer composed of magnetizable carrier and toner, or one-component developer composed of only magnetizable toner may be used as a developer, and frictional electricity of the magnetizable developer borne on a developing roller, as a developer bearing member, including a magnet is accelerated by employing a magnetizable limiting member to limit the thickness of the developer borne on the developing roller.

As such a magnetizable limiting member, there is known one which is formed of only a magnetizable member, and another which is formed of a non-magnetizable member and which includes a magnetizable member fixed thereupon, with the distal edge thereof facing the developing roller being aligned with that of the non-magnetizable member.

Further, there is also known an image forming apparatus having a rotary developing apparatus in which a plurality of developing devices, each including a magnetizable limiting member or a limiting member with a magnetizable tip-end, are disposed around a rotating shaft of the rotary developing apparatus. A latent image on an image bearing member is developed by moving the predetermined developing device to a developing station facing the image bearing member by rotating the rotary developing apparatus and by carrying developer borne on a surface of a developing roller of the developing device to a position to apply the developer to the image bearing member.

A latent image of each color of an image which is formed on the image bearing member is developed by a corresponding developing device of the aforementioned rotary developing apparatus and the developed image is transferred onto an intermediate transfer member. A full color image is formed by individually transferring each color toner image thus developed one after another onto the intermediate transfer member while superimposing one above the other.

In the above-described developing devices, the length of a magnet included inside the developing roller is generally made shorter than that of the developing roller and is positioned substantially in the middle of the developing roller, i.e., the lengthwise center of the magnet is aligned with that of the developing roller. A density of magnetic force lines at two ends of the magnet is greater than that at the middle of the magnet by diffraction of the magnetic force lines, and the magnetic force at the surface of the developing roller facing the two ends of the magnet is therefore stronger than that at the middle part of the developing roller. As a result, the amount of developer attracted to the surface of the developing roller becomes greater at the part of the developing roller facing the two ends of the magnet than at the part facing the middle part of the magnet, and accordingly, an excessive amount of the developer collects on the surface of the developing roller at the part facing the two ends of the magnet.

Because the excessive amount of the developer has fluidity to some extent, the developer at the parts of the developing roller facing the two ends of the magnet tends to move in a lateral direction towards ends of the developing roller in the axial direction of the developing roller (hereinafter referred to as two ends of the developing roller) from the parts of the developing roller facing the two ends of the magnet. On the other hand, both end parts of the developing roller not facing the magnet do not receive an effect of a magnetic force of the magnet. Therefore, if the developer is moved by the aforementioned lateral movement of the developer to the end parts of the developing roller not facing the magnet, the developer cannot be supported on the surface of the developing roller.

The developer moved to the end parts of the surface of the developing roller where the magnetic force is not exerted is immediately conveyed towards the image bearing member by a rotation of the developing roller, through an opening of the developing device casing and causes various problems as described below.

For example, even though the aforementioned developer carried to the developing position is further carried toward the inside of the developing device along with the rotation of the developing roller, a part of the developer cannot enter the clearance between an edge portion of the aforementioned opening and the surface of the developing roller and falls from the surface of the developing roller. Such falling phenomenon of the developer is called "developer overflow" and causes problems such that an internal part of the image forming apparatus is soiled with the developer, the developer adheres on a non-image part of the image bearing member (particularly, two end parts of the image bearing member) and the developer soils a recording member.

Further, the developer carried to the aforementioned developing position sometimes melts by being pressed between the image bearing member and the developing roller and is adhered to a surface of the image bearing member or the surface of the developing roller. Furthermore, when such melting and adhering phenomenon of the developer occur, various problems, such as, for example, abrasion of a surface layer of the image bearing member with the developer adhered to the developing roller, fouling of a background of a recording member with the developer adhered to the image bearing member, and insufficient cleaning effect for the image bearing member, are caused.

In addition, when excessive melting and adhering of the developer occurs, the frictional resistance between the limiting member and the developer on the developing roller, which is melted and adhered to each other is increased, and thereby torque required to rotate the developing roller becomes uneven. The unevenness of the torque causes unevenness of the rotation speed of the developing roller, resulting in a stripe image having a periodic unevenness of the density of the image.

In particular, in an image forming apparatus employing the above-mentioned rotary developing apparatus including a plurality of developing devices, when the developing apparatus rotates, the developing devices have postures different from each other. As illustrated in FIG. 2, when one developing device is in the developing station facing the image bearing member, another developing device that will be moved to the developing station next has a posture in which the developer is moved to the developing roller from the position above the developing roller and accordingly, a large amount of the developer is moved onto the developing roller by gravity. When the developer is moved by gravity to the developing roller, the frictional force between the developer and the surface of developing roller and an attractive force between the developer particles is small relative to the frictional force between the developer when the developer remains on the surface of the developing roller by being attracted by the magnetic force. Therefore, the developer being moved by gravity onto the developing roller easily moves in the lateral direction. Accordingly, in the image forming apparatus employing the rotary developing apparatus, the various problems as mentioned above also occur.

For solving the above-mentioned various problems, in Japanese Laid-Open Patent Publication No. 9-265238, a developing device having a magnetizable limiting member configured such that thickness or height at two ends thereof is greater than that at a middle part thereof is proposed. Further, in Japanese Laid-Open Patent Publication No. 8-202153, there is proposed a developing device in which a sealing member made of a magnetizable member is disposed adjacent to side faces of two ends of a limiting member in a longitudinal direction, and the magnetizable limiting member is disposed at a position approximately facing a magnet in a developing roller in a circumferential direction of the developing roller. The developing device thereby strengthens a concentration of the magnetic force lines between the limiting member and the developing roller at two end parts of the developing roller relative to the middle part of the developing roller in a longitudinal direction. That is, these developing devices have a magnetizable limiting member that is thicker at the two end portions facing end parts of the developing roller than at the other parts, or has protruding portions, so as to increase the magnetic force for the two end parts of the developing roller. Accordingly, the supporting force for the developer borne at the two end parts of the developing roller is strengthened and the developer is prevented from being conveyed towards the image bearing member through an opening of the developing device casing by a rotation of the developing roller.

However, in the developing device that employs the magnetizable limiting member formed of only a magnetizable member, or a limiting member which is formed of a non-magnetizable member and which includes a magnetizable member fixed thereupon with the distal edge thereof facing the developing roller being aligned with that of the non-magnetizable member, there is a shortcoming that an amount of the developer passing through a developing doctor gap between a distal edge of the limiting member and the surface of the developing roller fluctuates according to variations of the developing doctor gap which may be caused by assembly errors and so forth.

Further, in the developing devices having the magnetizable limiting member or a non-magnetizable member with a magnetizable member fixed thereupon at the distal edge portion thereof as described above, when a distance between the limiting member and the developing roller is set so that a limited amount of the developer required for forming an image can be obtained, the magnetic force of the limiting member excessively affects the developer on the surface of the developing roller, resulting in application of excessive stress on the developer. The excessive stress deteriorates characteristics of the developer. More specifically, when two-component developer composed of magnetizable carrier and toner is used, a charging capacity of the magnetizable carrier is significantly decreased due to wear of coating of the carrier and, as a result, an expected life of the developer cannot be obtained.

SUMMARY OF THE INVENTION

The present invention has been made in view of the above-discussed problems and an object of the invention is to address and resolve these and other problems.

According to a preferred embodiment of the present invention, a novel image forming apparatus includes an image bearing member and a developing device positioned to supply a developer to a developing position of the image bearing member, to develop a latent image on a surface of the image bearing member. The developing device includes a developing device casing, a rotatable developer bearing member in the developing device casing and having a magnet therein, the developer bearing member being so positioned in the developing device that upon rotation of the developer bearing member, the developer bearing member bears developer on a surface thereof by a magnetic force of the magnet and carries the developer towards the developing position, a limiting member made of a non-magnetizable material and positioned facing the developer bearing member so as to limit a thickness of a layer of the developer borne on the developer bearing member; and a magnetizable member having a protruding portion positioned to face a part of the developer bearing member that does not have the magnet therein, and a recessed part positioned to face a part of the developer bearing member that has the magnet therein, the magnetizable member being disposed upstream of the limiting member in a developer conveying direction of the developer bearing member. The protruding portion is nearer to the surface of the developing roller than is the limiting member and the recessed part is more distant from the surface of the developing roller than is the limiting member.

A sealing member that contacts a part of the surface of the developer bearing member not facing the magnet is provided near both ends of the limiting member in a longitudinal direction thereof, and a magnetizable member is provided upstream of the limiting member in a developer conveying direction of the developer bearing member such that the magnetizable member is more distant from a surface of the developer bearing member than the limiting member at least at a part facing the magnet.

The magnetizable member is provided to the limiting member upstream of the limiting member in a developer conveying direction of the developer bearing member such that the magnetizable member is more distant from a surface of the developer bearing member than the limiting member at a part of the magnetizable member facing the magnet, and an adjacent part of ends of the developer bearing member including two or more poles of the magnet in a developer conveying direction of the developer bearing member is positioned inside one of the walls of the developing device casing such that end surfaces of the magnet are positioned inside of the wall of the developing device casing by about 0.5 mm to 2.0 mm.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein:

FIG. 13 is an illustration showing the developing roller and bearing portions of the developing device casing.

DESCRIPTION OF THE PREFERRED EMBODIMENTS

Figure 1:
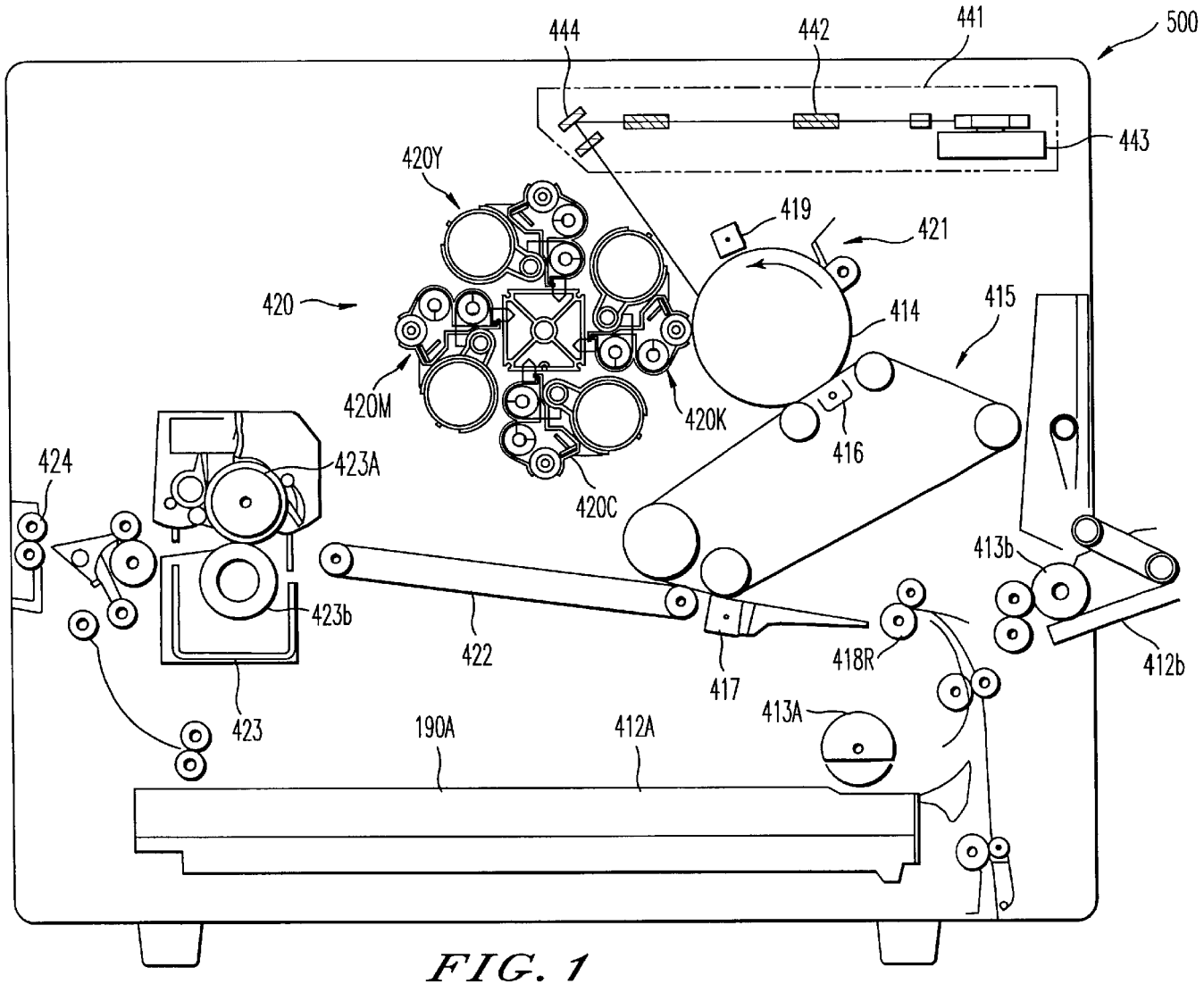
FIG. 1 is a schematic illustration of a color copying machine of a first embodiment.

An embodiment of the present invention is described in detail referring to the drawings, wherein like reference numerals indicate identical or corresponding parts throughout the several views.

A first embodiment in which the present invention is applied to a color copying machine as an image forming apparatus is explained hereinbelow.

FIG. 1 schematically illustrates a configuration of a color copying machine 500 according to the first embodiment of the present invention. In FIG. 1, numeral 441 denotes a laser exposing device, numeral 442 denotes an f theta lens, numeral 443 denotes a rotary polygon mirror, numeral 444 denotes a mirror. Numeral 412A denotes an automatic sheet feeding cassette that serves for a duplex copying mode, numeral 412B denotes a manual sheet feeding tray, numerals 413A and 413B denote sheet feeding rollers, respectively. Numeral 418R denotes a registration rollers pair, numeral 414 denotes a photoconductive drum as an image bearing member, numeral 415 denotes an intermediate transfer member (an intermediate transfer belt), numeral 416 denotes a first transfer device (a first transfer corotron), numeral 417 denotes a second transfer device (a second transfer corotron), numeral 419 denotes a charging device (charging scorotron), numerals 420C, 420M, 420Y, and 420K respectively denote developing devices for cyan, magenta, yellow, and black, numeral 420 denotes a rotary developing apparatus as an aggregate of each of the developing devices. Numeral 421 denotes a cleaner, numeral 422 denotes a conveyer belt, numeral 423 denotes a fixing device, numeral 423A denotes a fixing roller, numeral 423B denotes a fixing backup roller, and numeral 424 denotes sheet discharge rollers pair.

The color copying machine 500 forms a full color visible image in a dot pattern with a writing dot density of 400 dpi (dots per inch) or 600 dpi for each of the colors, i.e., cyan, magenta, yellow, and black, in both of a main scanning and a sub-scanning operations in accordance with two-bit read data which is input to a control device (not shown) and by superimposing the images for each color one upon the other. A selection of the recording dot density of 400 dpi or 600 dpi is previously determined by a mode selection command. The dot density is set to 400 dpi by default in this embodiment.

In the copying machine 500 having the aforementioned configuration, when an image forming cycle is started, the photoconductive drum 414 is rotated counterclockwise and the intermediate transfer belt 415 is rotated clockwise by a drive system (not shown). Along with a rotation of the intermediate transfer belt 415, toner image forming operations for cyan toner image, magenta toner image, yellow toner image and black toner image are performed, respectively, and a full color toner image is completed by superposing the color toner images in the order of cyan, magenta, yellow and black onto the intermediate transfer belt 415.

The image forming operation for cyan toner is performed in accordance with the following procedure. First, the charging scorotron 419 uniformly charges the photoconductive drum 414, for example, at −700 v DC. Then, the laser exposure device 441 performs a raster exposure according to a cyan image signal. In a usual copying mode, a recording signal for an image forming operation is generated by a scanner unit. In a special printing mode including an intelligent image processing, such as, for example, enlargement or reduction of an image, color conversion, trimming of an image, and the like, the recording signal for the image forming operation is generated by a system control unit (not shown).

The printer unit generates a data requesting signal REQ that designates "send recording data after a predetermined time", and sends the signal REQ to the system control unit in the printing or facsimile mode, and in the copying mode, the printer unit sends the same requesting signal REQ to the scanner unit.

The recording signal is input from the transmission control device to a laser drive circuit (not shown) as a recording control circuit and the laser drive circuit controls the laser exposing device 441 to emit laser light to a unit of an input pixel according to the recording signal. The recording signal is formed of two bits per one pixel. More in detail, the laser light emits for a time period corresponding to a full width in the main scanning direction for a maximum density of the cyan color pixel. The laser light does not emit at all for a white pixel. Further, when the recording signal carries half tone image data, the laser light emits for a time period proportional to the halftone-image density data. When the photoconductive drum 414 is exposed to a raster image as mentioned-above, the exposed part of the photoconductive drum 414 that is uniformly charged in the initial state loses a charge proportional to the amount of the laser light, and thereby an electrostatic latent image is formed.

The toner in the developing device in a rotary developing apparatus 420, which is mixed with ferrite carrier (hereinafter called carrier, simply), is charged to a negative polarity by an agitating operation, and a cyan developing roller 41C in the cyan developing device 420C is electrically biased to a potential in which a negative DC potential and an AC potential are superimposed by a power source device (not shown) relative to a metal substrate layer of the photoconductive drum 414. Consequently, the cyan toner is not adhered to a part of the photoconductive drum 414 where the charge remains and the cyan toner is adhered to the part where the charge does not remain, i.e., the cyan toner is adhered to the exposed part of the photoconductive drum 414. Thereby, a cyan visible toner image conforming to the electrostatic latent image is formed.

When the thus formed cyan toner image on the photoconductive drum 414 that rotates counterclockwise reaches a position facing to a first transfer corotron 416, the cyan toner image is transferred onto the intermediate transfer belt 415 that is in contact with the photoconductive drum 414 and is driven in synchronism with the rotation of the photoconductive drum 414 by a corona transferring operation. Residual toner on the photoconductive drum 414 that is not transferred onto the intermediate transfer belt 415 is removed from the surface of the photoconductive drum 414 by the cleaner 421 for the next copying operation. The toner reclaimed by the cleaner 421 is accumulated in a toner discharging tank (not shown) through a reclaiming pipe.

The aforementioned intermediate transfer belt 415 is made of a material having a relatively large specific resistance, such that a stable timewise image bearing characteristic of the intermediate transfer belt 415, which is highly required particularly for the printing mode, is obtained. The intermediate transfer belt 415 is thereby capable of bearing the toner image without disturbing the same even though the time interval between the finish of an image forming operation for a color and the start of a successive image forming operation for another color is long, for example, 20 minutes.

Next, the image forming operation with magenta toner is performed according to a magenta image signal (hereinafter referred to as M-signal). A magenta developing roller 41M of a magenta developing device 420M is moved to the developing station of the photoconductive drum 414 by rotation of the rotary developing apparatus 420 counterclockwise preceding the exposure with the magenta raster data. Then a leading edge of the previously formed cyan visible image is detected with leading edge detecting device (not shown). Further, the data requesting signal REQ is also sent to the scanner unit.

The data requesting signal REQ is generated when a cyan toner image registration mark (hereinafter referred to as C-toner mark) formed on the intermediate transfer belt 415 slightly upstream of the cyan toner image, which is formed in a previous image forming process, is detected by the image leading edge position detecting device. The leading edge detecting device can be replaced with a device in which the data requesting signal REQ is generated by detecting a durable mark previously formed on the intermediate transfer belt 415 instead of the C-toner mark.

When the M-signal is sent, synchronizing with the data requesting signal REQ, the procedure of image forming operation, such as charging the photoconductive drum, the exposure with the magenta raster data to form the magenta latent image, the development of the magenta latent image, and the like for the magenta toner image, is performed, and the magenta toner image formed on the photoconductive drum 414 is transferred onto the intermediate transfer belt 415, superimposed with the cyan toner image that is previously transferred.

The magenta toner in the magenta developing device 420M is charged to a negative polarity and the magenta toner and the carrier on the magenta developing roller 41M of the magenta developing device 420M contact the photoconductive drum 414. Further, the magenta toner and carrier are biased to substantially the same potential as those of the cyan toner when the cyan image has been developed. The magenta toner is therefore not attracted to a part of the photoconductive drum 414 where the charge of the negative polarity remains but is attracted to the part of the drum exposed to the laser light according to the M-signal. A magenta visible image corresponding to the magenta electrostatic latent image is thus formed.

In the same manner as described above, a yellow toner image is superimposed onto superimposed cyan and magenta toner images, and a black toner image is superimposed onto superimposed cyan, magenta and yellow toner images, respectively. Thus, a full color image is formed. In this embodiment, because a basic image processing device (not shown) performs an under color removal (U.C.R.) process, it rarely occurs that a pixel is developed with all of the four color toners.

The full color image formed on the intermediate transfer belt 415 is then moved to a second transfer station facing a second transfer corotron 417.

When the image forming operation starts, a transfer sheet 190A as a recording member, which is fed from one of three sheet feeding sections, i.e., a cassette 412A, a manual sheet feeding tray 412B, and an external sheet feeding device (not shown), is further fed by a rotation of the sheet feeding rollers 413A or 413B, or a feeding operation of the external sheet feeding device, and stops at a nip portion between the registration rollers pair 418R. Further, the registration rollers pair 418R starts to rotate to feed the transfer sheet 190A, so that the leading edge of the transfer sheet 190A is aligned with the leading edge of the toner image on the intermediate transfer belt 421, when the leading edge of a toner image on the intermediate transfer belt 421 reaches the second transfer corotron 417.

Thus, the transfer sheet 190A passes the second transfer corotron 417, which is connected to a power source (not shown) that outputs a high voltage with positive polarity, while in contact with the full color toner image on the intermediate transfer belt 415. The transfer sheet 190A is charged with positive polarity by a corona discharge current from the corotron 417, so that the toner image on the intermediate transfer belt 415 is transferred onto the transfer sheet 190A and most of the toner image is transferred onto the transfer sheet 190A. The charge on the transfer sheet 190A is discharged when the transfer sheet 190A passes through a discharge needle (not shown) connected to ground and located slightly leftward of the second transfer corotron 417 in FIG. 1, and an attractive force of the intermediate transfer belt 415 and the transfer sheet 190A is almost vanished. As a result, the weight of the transfer sheet 190A exceeds the attractive force of the intermediate transfer belt 415 and the transfer sheet 190A, and so the transfer sheet 190A moves onto the conveyer belt 422 and away from the intermediate transfer belt 415.

The transfer sheet 190A carrying the toner image thereupon is conveyed to the fixing device 423 by the conveyer belt 422. Heat and a pressure are applied to the transfer sheet 190A at a nip portion between the heated fixing roller 423A and the fixing backup roller 423B, and the melted toner intrudes into fibers of the transfer sheet 190A. A full color copy is completed with the image being thus fixed to the transfer sheet 190A. The copy is then discharged from the main body of the image forming apparatus with the sheet discharge rollers pair 424 and is stacked on a tray (not shown) with the image side face up.

Figure 2:
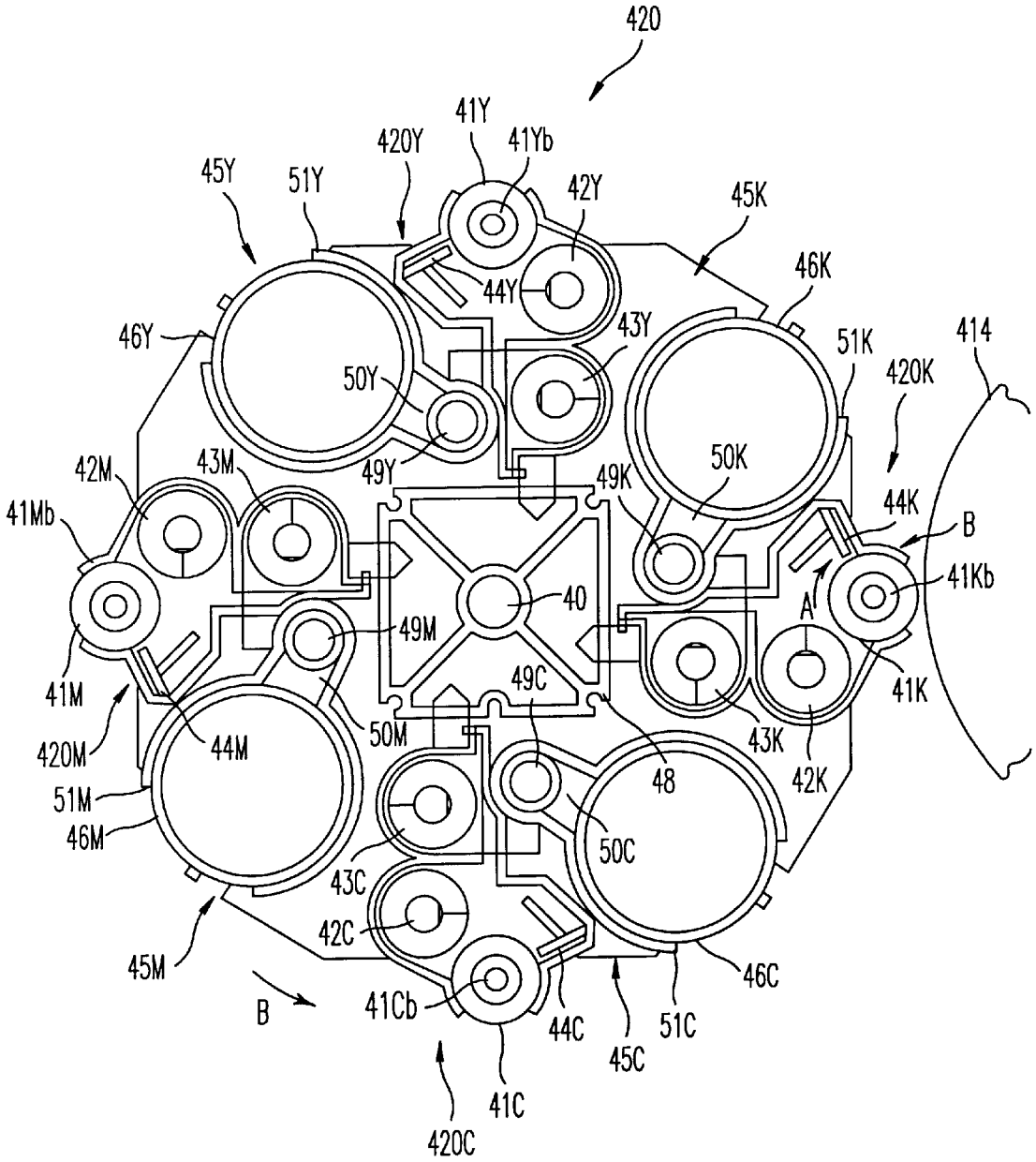
FIG. 2 is a schematic side view illustrating a rotary developing apparatus of the color copying machine of FIG. 1.

Next, a configuration of the rotary developing apparatus 420 is explained. FIG. 2 is a schematic side view of the rotary developing apparatus 420. The rotary developing apparatus 420 is provided with an opening that faces the photoconductive drum 414 and is also provided with four developing devices 420K, 420Y, 420M, and 420C having substantially the same configuration and being disposed in a circumferential direction of the rotary developing apparatus 420 at an even distances from each other. The developing devices 420K, 420Y, 420M, and 420C have developing units including toner supplying devices 45K, 45Y, 45M, and 45C, respectively, to supply color toner into the respective developing devices.

In the example of FIG. 2, a black developing device 420K containing black toner and carrier is positioned at the developing station facing the photoconductive drum 414. A yellow developing device 420Y containing a yellow toner and carrier, a magenta developing device 420M containing a magenta toner and carrier, and a cyan developing device 420C containing a cyan toner and carrier are disposed in a counterclockwise direction.

Because the internal structure of each of the four developing devices 420K, 420Y, 420M, 420C is substantially the same, the internal structure of the developing device is hereinbelow explained using the black developing device 420K as an example. Further, the explanation of the internal structures of the developing devices other than the black developing device 420K is omitted by denoting like numerals which subscripts Y, M and C for yellow, magenta and cyan, to corresponding elements in each developing devices.

The black developing device 420K has simple structure including the developing roller 41K as a developer bearing member, the developing device casing walls 47K, first and second agitating screws 42K and 43K that agitate two-component developer (hereinafter referred to as a developer) contained in a developing device casing section, and a developing doctor 44K as a limiting member that regulates the thickness of a layer of the developer borne on the developing roller 41K.

As illustrated in FIG. 2, each of the developing devices 420K, 420Y, 420M and 420C is detachably mounted on a unit supporting member 48 which is unitary with a rotation shaft 40 of the rotary developing apparatus 420. In addition, the toner supplying devices 45K, 45Y, 45M and 45C of the developing units are formed integrally with the unit supporting member 48 in a body, and rotate with the unit supporting member 48 by rotation of the rotation shaft 40.

The toner supplying devices 45K, 45Y, 45M and 45C include toner supplying screws 49K, 49Y, 49M and 49C, toner supplying cases 50K 50Y, 50M and 50C, and toner cartridge guides 51K, 51Y, 51M and 51K, respectively.

The toner cartridges 46K, 46Y, 46M and 46C containing color toners of black, yellow, magenta and cyan are attached to or detached from the toner cartridge guides 51K, 51Y, 51M and 51C in a direction perpendicular to a surface of FIG. 2 through an opening (not shown) of the respective toner supplying device. When the toner cartridges 46K, 46Y, 46M and 46C are fully inserted into the respective toner cartridge guides 51K, 51Y, 51M and 51C, a necessary amount of the toner in the toner cartridges is fed into the aforementioned toner supplying cases 50K, 50Y, 50M and 50C. The toner is gradually supplied to ends of the second agitating screws 43K, 43Y, 43M and 43C in the developing device casings 47K, 47Y, 47M and 47C of the developing devices 420K, 420Y, 420M and 420C by rotation of the toner supplying screws 49K, 49Y, 49M and 49C, respectively. Further, the toner supplying operation is performed when one of developing devices is positioned at the developing station facing the photoconductive drum 414 (the black developing device 420K in the example of FIG. 2).

The black toner supplied to the front end of the second agitating screw 43K of the black developing device 420K is conveyed to a rear end of the developing device casing 47K while being agitated by the rotation of the second agitating screw 43K and is spread into the developer in the developing device casing 47K. Then the black toner is conveyed from the second agitating screw 43K to the first agitating screw 42K and is further conveyed to a front end of the developing device casing 47K while being agitated by the rotation of the first agitating screw 42K. The black toner is then again conveyed from the first agitating screw 42K to the second agitating screw 43K at the front side of the developing device casing 47K and this circulation continues.

A part of the developer that is thus circulated in the developing device casing 47K is scooped up by the developing roller 41K having an internal magnet 41K*b* and is conveyed in the direction indicated by an arrow A in FIG. 2, while being borne thereupon. The developer conveyed by the developing roller 41K is further conveyed to the developing area of the developing roller 41K after the thickness of the layer of the developer on the developing roller 41K is reduced by the non-magnetizable developing doctor 44K as a limiting member, and develops the electrostatic latent image on the photoconductive drum 414 into a toner image.

Figure 4:
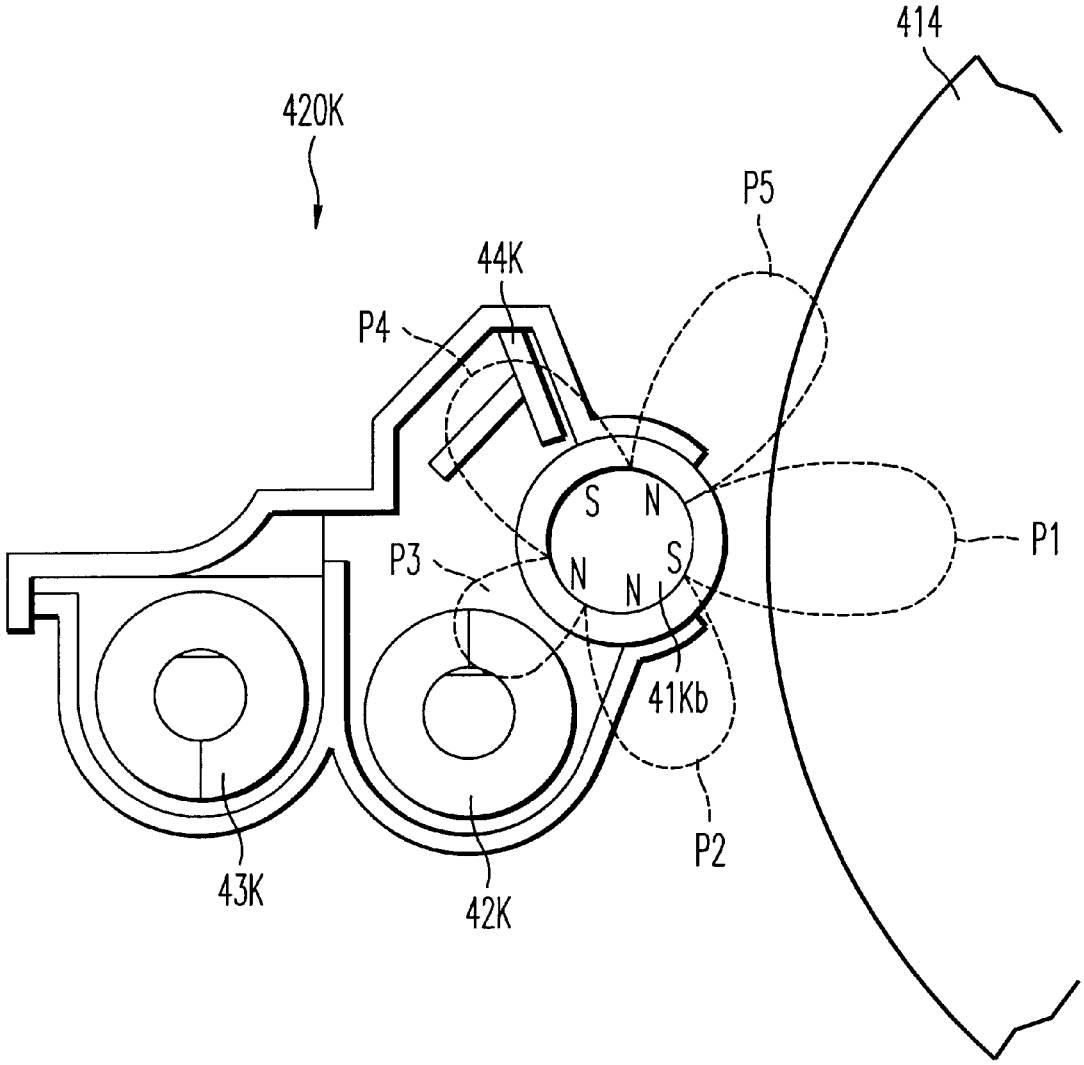
FIG. 4 is a cross sectional view illustrating a black developing device together with a photoconductive drum.

FIG. 4 is a cross sectional view illustrating a black developing device 420K with the photoconductive drum 414. In FIG. 4, the magnet 41K*b* is fixed and is configured not to rotate along with rotation of the developing roller 41K. The magnet 41K*b* is provided with five magnetic poles, composed of two South poles and three North poles, and causes magnetic fields P1, P2, P3, P4 and P5. The strength of the magnetic field is weakened around a boundary of the aforementioned magnetic fields. In the color copying machine of the first embodiment of the present invention, the developing doctor 44K is disposed just above the South pole as the fourth magnetic pole. That is, the developing roller 44K is not placed between the magnetic fields, i.e., the developing doctor 44K is not placed at a position facing a part of the developing roller between the magnetic poles but is placed at a position just above one of the South poles, as illustrated in FIG. 4. By thus disposing the developing doctor 44K, an amount of the developer passing through a gap between the developing doctor 44K and the developing roller 41K can be limited by the magnetic force of sufficient strength.

On the other hand, when the rotary developing apparatus 420 is in a position in which one developing device is in the developing station facing the image bearing member, another developing device that will be moved to the developing station next has a posture in which the developer is moved by gravity to the developing roller, and therefore developer on the part of the developing roller facing the two ends of the magnet therein tends to laterally move towards end portions of the developing roller in the longitudinal direction as described earlier. If the magnetic force applied to the two ends of the developing roller 41K is strengthened by making the developing doctor 44K from a magnetizable member or from a non-magnetizable member having a magnetizable member fixed thereupon at the distal edge thereof, and by further making the two end parts of the developing doctor 44K thicker than other parts or forming the two end parts of the developing doctor 44K in a shape protruding to the surface of the developing roller to increase the magnetic force applied to the end portions of the developing roller 41K, an excessive stress is applied to the developer adhered to the middle part of the developing roller 41K.

Figure 5:
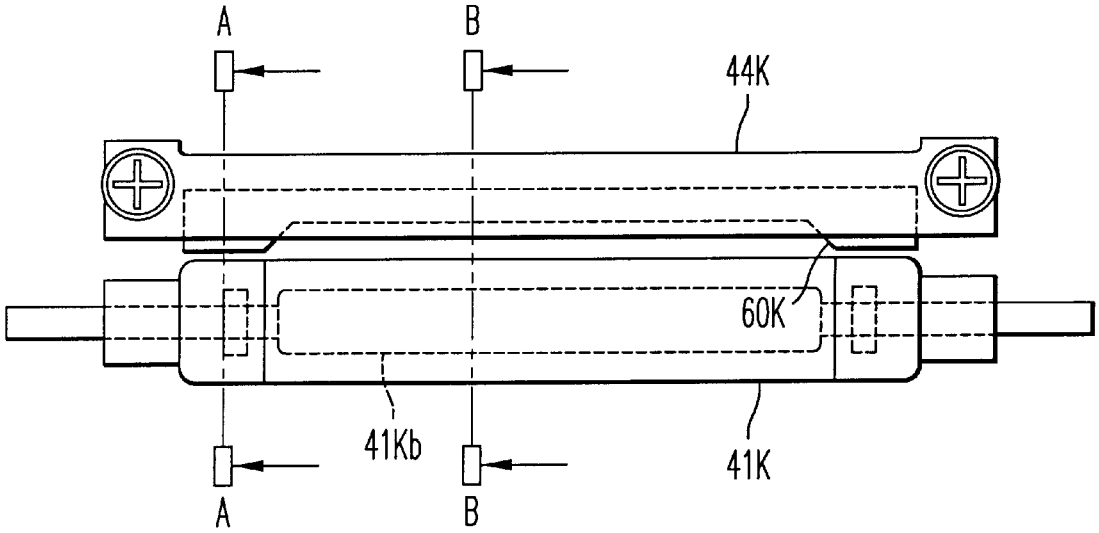
FIG. 5 is a detailed illustration showing a developing roller and a developing doctor looking from a direction indicated by an arrow B of FIG. 2.
Figure 6:
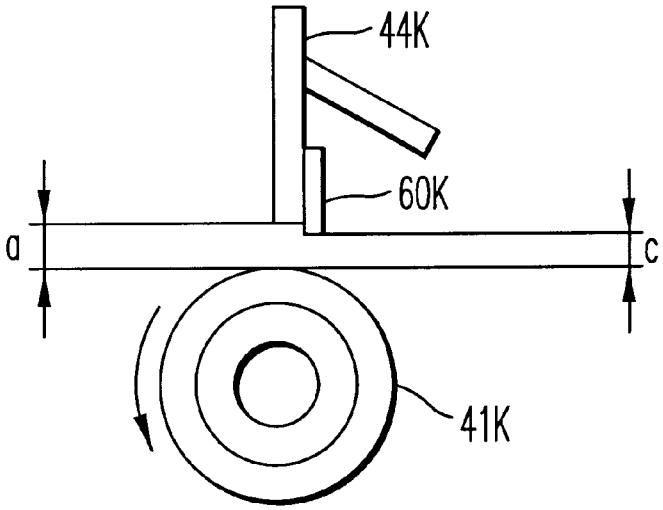
FIG. 6 is an A—A cross sectional view of FIG. 5.
Figure 7:
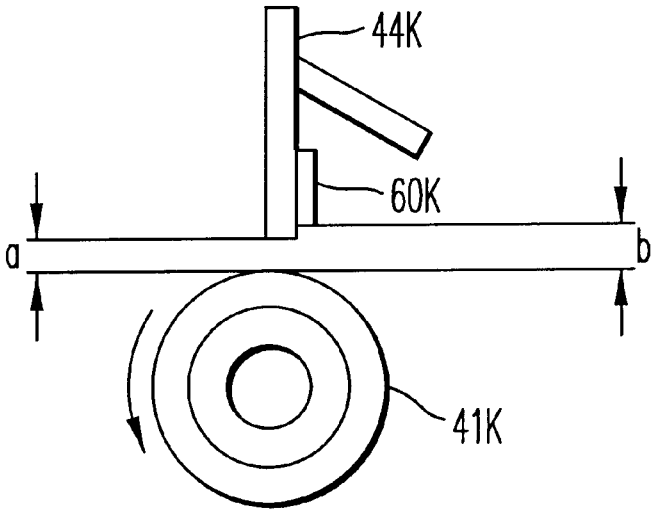
FIG. 7 is a B—B cross sectional view of FIG. 5.

Therefore, for example, the color copying machine of the present invention is provided with a developing device 420K having a configuration shown in FIGS. 5 to 7 as explained hereinbelow to decrease such problems as excessive stress applied to the developer. FIG. 5 is an illustration showing the developing roller 41K and the developing doctor 44K looking from the direction indicated by an arrow B in FIG. 2. FIG. 6 is a cross sectional view along a line A—A of FIG. 5. and FIG. 7 is a cross sectional view along a line B—B of FIG. 5. As illustrated in each of FIGS. 6 and 7, at an area facing the developing roller 41K, a magnetizable member 60K, that extends in a longitudinal direction of the developing roller 41K as shown in FIG. 5, is disposed at an upstream side in a rotating direction of the developing roller 41K relative to the developing doctor 44K. The magnetizable member 60K is provided with a recessed part in the middle and having a length and position corresponding to the length and position of the magnet 41K*b*. The magnetizable member 60K is positioned such that the recessed part is more distant from an outer surface of the developing roller 41K than the distal edge of the developing doctor 44K in an area facing the magnet 41K*b*, as shown in FIGS. 5 and 7.

Further, as illustrated in FIGS. 5 and 6, the protrusions of the magnetizable member 60K protruding towards the outer surface of the developing roller 41K are located nearer to the developing roller 41K at two end parts of the developing roller 41K not facing the magnet 41K*b* than the distal edge of the developing doctor 44K.

In the configuration illustrated in FIGS. 5 to 7, a limiting operation of the developer layer on the developing roller 41K is performed by the developing doctor 44K made of a non-magnetizable member and thereby a necessary amount of the developer for forming an image is obtained by being passed through the gap between the developing doctor 44K and the developing roller 41K.

Further, a charging operation for the developer is accelerated, while decreasing the magnetic force applied to the developer on the developing roller 41K in comparison with using a developing doctor made of only a magnetizable member or a developing doctor made of a non-magnetizable member having a magnetizable member at the distal edge portion thereof, by forming the recessed part in the magnetizable member 60K at the part facing the magnet 41K*b* and by placing the recessed part of the magnetizable member 60K to be more distant from the outer surface of the developing roller 41K than the distal edge portion of the developing doctor 44K. Thereby, a frictional charging operation for the developer can be accelerated while applying the magnetic force with a strength that does not apply excessive stress to the developer on the developing roller 41K.

Furthermore, in the color copying machine of the present invention, the lateral movement of the developer to the ends of the developing roller 41K is decreased by increasing a magnet force applied to the two end parts of the developing roller 41K by forming the aforementioned protrusions. In addition, the excessive amount of the developer that collects on the two end parts of the developing roller 41K is prevented from moving through a clearance between each of two edges of the opening of the developing device casing 47K and the developing roller 41K, towards the opening of the developing device casing 47K, by the magnetic force of the protrusions.

The recessed part of the magnetizable member 60K is positioned rearwardly from the distal edge portion of the developing doctor 44K relative to the developing roller 41K by 0.5 mm, and the protrusions of the magnetizable member 60K protrude towards the developing roller 41K relative the distal edge portion of the developing doctor 44K by 0.3 mm.

In FIGS. 6 and 7, character "a" denotes a distance between the outer surface of the developing roller 41K and the distal edge portion of the developing doctor 44K, character "b" denotes a distance between the outer surface of the developing roller 41K and the distal edge portion of the recessed part of the magnetizable member 60K, and character "c" denotes a distance between the outer surface of the developing roller 41K and the distal edge portion of the protrusion of the magnetizable member 60K.

It has been found that when a formula (1) below is satisfied, developer can be frictionally charged satisfactorily while applying a magnetic force without applying an excessive stress to the developer on the developing roller 41K:

$$\text{distance } b \leqq \text{distance } a + 0.3 \text{ mm} \quad (1)$$

Further, when a formula (2) below is satisfied, developer can be prevented from being laterally moved and the excessive amount of the developer that collects on the two end parts of the developing roller 41K is prevented from moving through a clearance between each of two edges of the opening of the developing device casing 47K and the developing roller 41K, towards the opening of the developing device casing 47K, by supporting the developer at the two end parts of the developing roller 41K by the attractive force of the magnetic force strengthened by the protrusions of the magnetizable member 60K:

$$\text{distance } c \geqq \text{distance } a - 0.1 \text{ mm} \quad (2)$$

Therefore, in the color copying machine of the first embodiment of the present invention, the distance a is set to 0.5–0.7 mm, the distance b is set to 1.0–1.2 mm, and the distance c is set to 0.2–0.4 mm, respectively.

Figure 8:
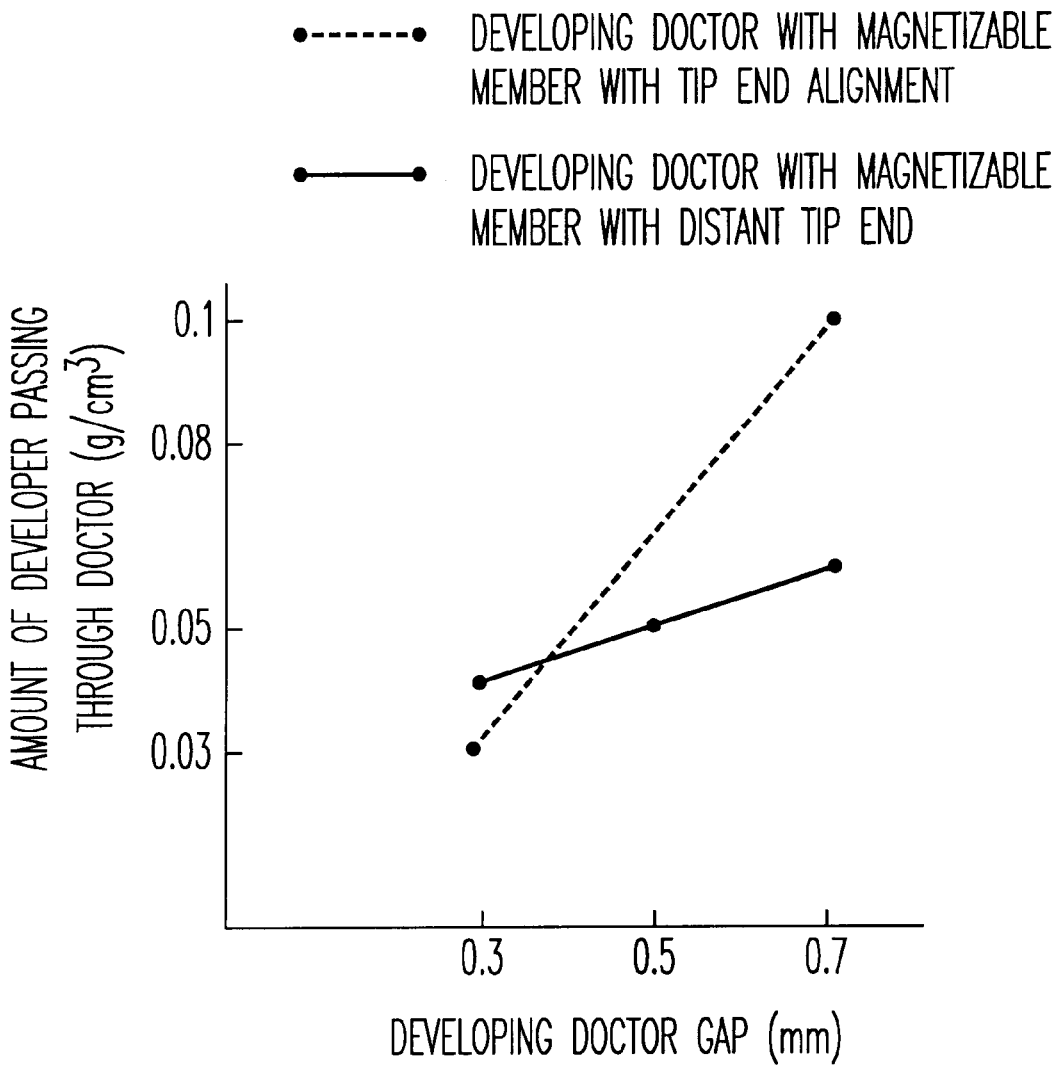
FIG. 8 is an illustration showing a relationship between a developing doctor gap and an amount of developer passing through the developing doctor gap at a setting position of a magnetizable member to the developing doctor.

A moving state of developer that passes through the developing doctor gap formed between the developing doctor 44K and the developing roller 41K in the thus configured developing device has been compared with that in the background developing device including a limiting member formed of a non-magnetizable member and having a magnetizable member fixed thereupon at the distal edge portion facing the developing roller. As a result, it has been found that a fluctuation of the amount of the developer passing through the developing doctor gap according to a variation in the distance "a" (i.e., a variation in the developing doctor gap) is smaller in the developing device 420K, as illustrated in FIG. 8. Accordingly, in the developing device 420K the fluctuation of the amount of the developer passing through the developing doctor gap, which is caused by unevenness of mechanical accuracy of assembling the limiting member, can be kept small and a supplied amount of the developer at the developing station can be kept stable. Thus, the color copying machine of the present invention can avoid the shortcomings of the conventional developing device.

Figure 9:
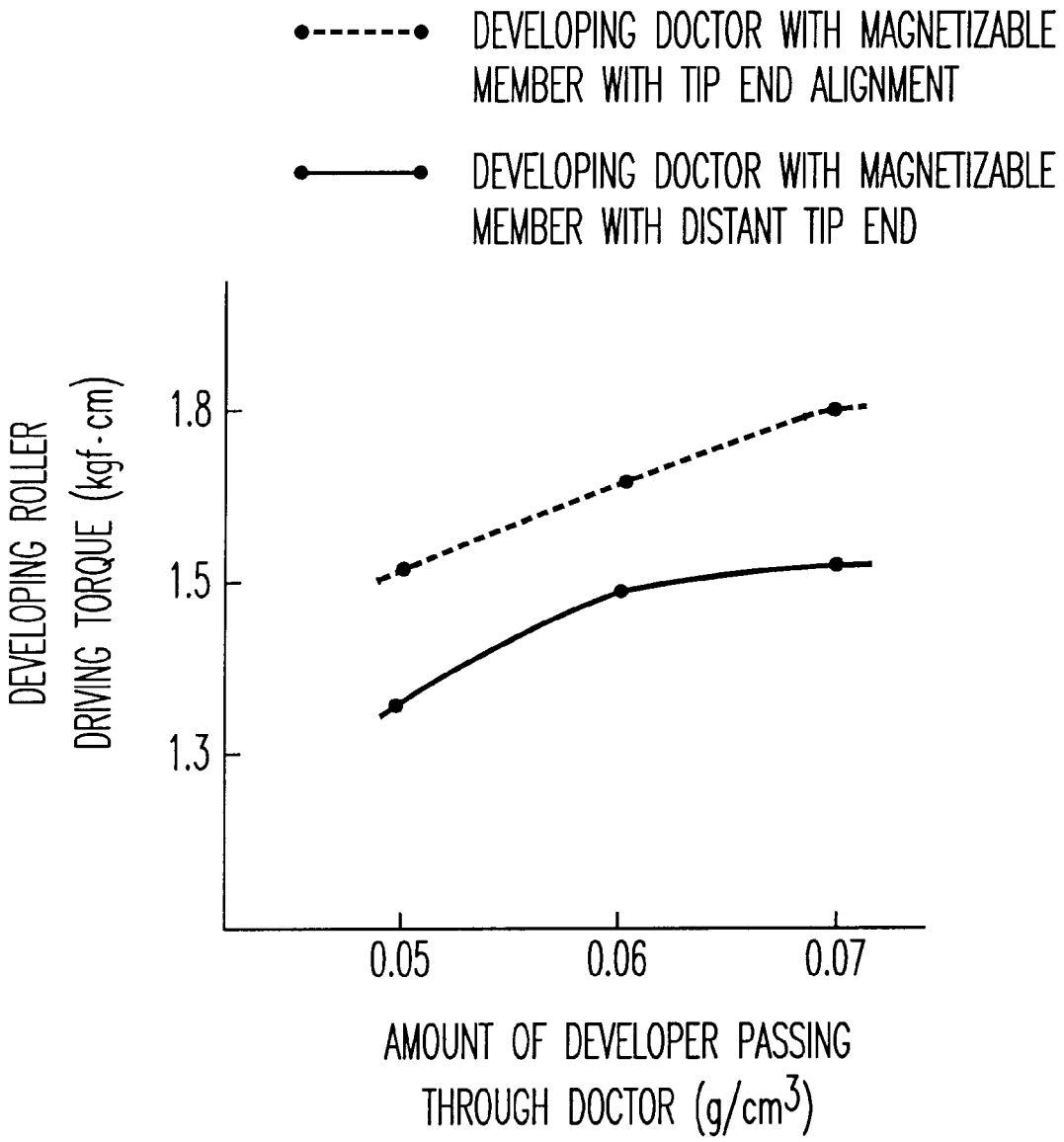
FIG. 9 is an illustration showing a relationship between the amount of the developer passing through the developing doctor at the setting position of the magnetizable member to the developing doctor and a driving torque of the developing roller.

Further, as illustrated in FIG. 9, the torque required to rotate the developing roller for carrying a required amount of the developer through the developing doctor gap is found to be smaller. Therefore, the stress applied to the developer at the developing doctor gap is smaller and deterioration of the developer can be decreased.

As illustrated in FIGS. 5, the edge of the recessed part of the magnetizable member 60K and the two protrusions at two end parts of the magnetizable member 60K are formed in parallel with each other and face the outer surface of the developing roller 41K, respectively. Steps connecting the edge of the recessed part and edges of the two protrusions are tapered as illustrated in FIG. 5. The ends of the magnet 41K*b* face the tapered steps. By thus tapering the steps between the recessed part and the protrusions, the magnetic force lines that concentrate in the vicinity of the steps can be dispersed.

Figure 10:
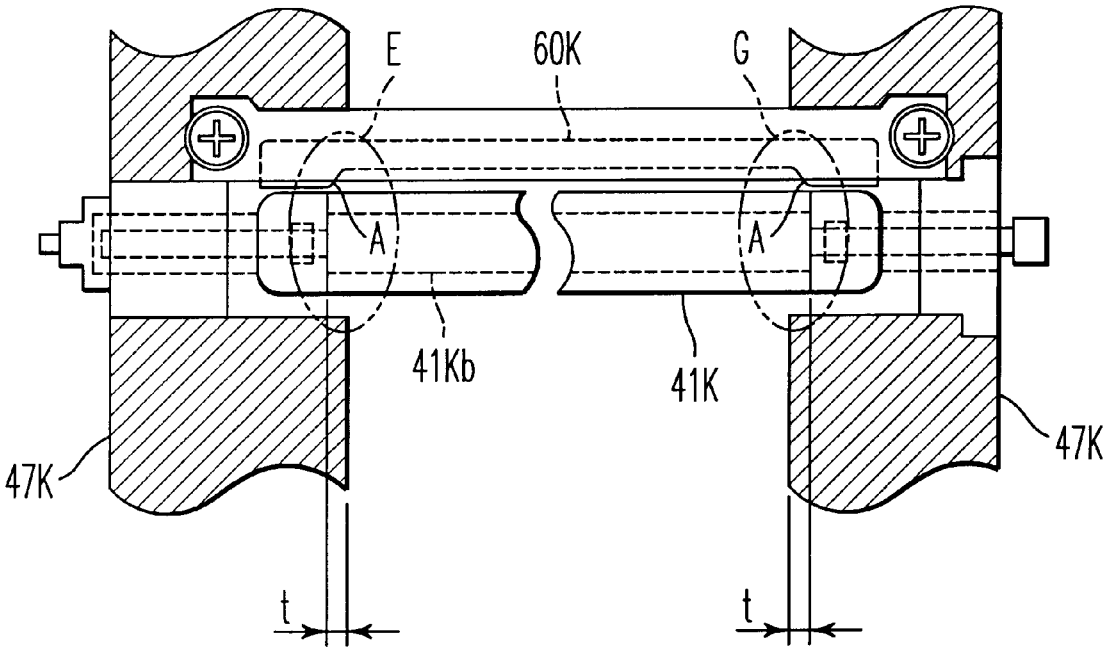
FIG. 10 is an illustration showing a developing roller and bearing portions of a developing device casing.

Next, a configuration of the developing roller 41K and the developing device casing 47K is explained referring to FIG. 10. The developing roller 41K is supported by bearings fit in the developing device casing 47K at two ends of the developing roller 41K. The developing roller 41K includes the magnet 41K*b*, and the end parts of the developing roller 41K including two or more magnetic poles in a circumferential direction of the developing roller 41K are positioned within developing device casing 47K.

As illustrated in FIG. 10, end surfaces of the magnet 41K*b* in the developing roller 41K are respectively positioned within the wall of the developing device casing 47K by a distance t, (hereinafter, the distance t is referred to as an extending amount of the magnet 41K*b*). The extending amount t of the magnet 41K*b* is equal to or less than 1 mm in this embodiment.

If the extending amount t of the magnet 41K*b* is nearly zero or 1 mm, a fall off of the developer from the outer surface of the developing roller 41K occurs because a magnetic force that attracts the developer borne on the surface of the developing roller 41K is relatively weak at the two end parts thereof where the magnet 41K*b* does not face the developing roller 41K. If the extending amount t of the magnet 41K*b* is excessively large, for example, more than 5 mm, an extreme adhesion of the developer to the outer surface of the two end parts of the developing roller 41K due to the frictional heat of the developer occurs because a large amount of the developer collects and tends to pass through the clearance between the developing roller 41K and the developing device casing 47K at the two end parts of the developing roller 41K.

An appropriate extending amount t of the magnet 41K*b* is 0 to 2.0 mm, as found by experiments. The developer borne on the two end parts of the developing roller 41K is prevented from being carried to the opening of the developing device casing 47K by thus configuring the developing roller 41K and the developing device casing 47K so as to have the extending amount t of the magnet 41K*b* and by configuring the magnetizable member 60K as described above. In addition, the two end parts of the magnetizable member 60K are positioned adjacent to the surface of the developing roller 41K located inside one of the walls of the developing device casing 47K.

Next, a color copying machine of the second embodiment to which the present invention is applied is explained. Because the basic configuration of the color copying machine is substantially the same as that of the aforementioned first embodiment, the explanation about the basic configuration is omitted.

Figure 11A:
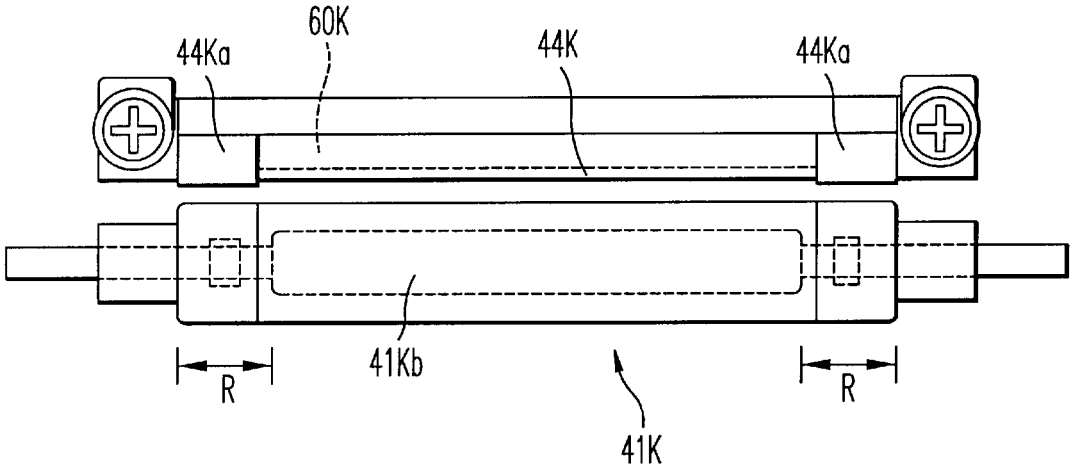
FIG. 11A is an illustration showing the developing roller of the second embodiment and the developing doctor looking from a direction indicated by an arrow B of FIG. 2.
Figure 11B:
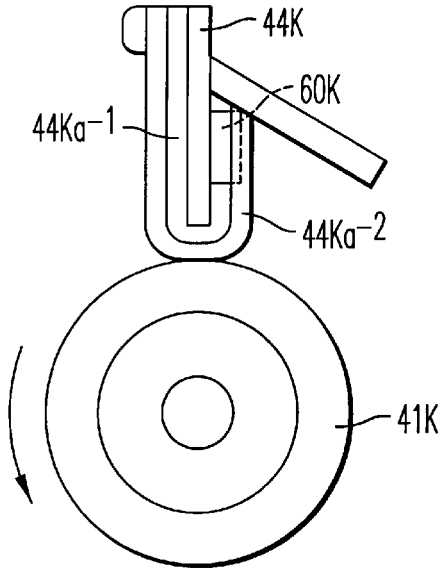
FIG. 11B is a cross sectional view showing a sealing portion of the developing doctor of FIG. 11A.

FIG. 11A is an illustration showing the developing roller 41K and the developing doctor 44K looking from the direction indicated by an arrow B in FIG. 2. FIG. 11B is a cross sectional view of a sealing portion 44K*a* of the developing doctor 44K. As illustrated in FIG. 11A, the developing doctor 44K is provided with a sealing portion 44K*a* at positions adjacent to two longitudinal end portions of the developing roller 41K. The sealing portions 44K*a* each includes a substrate 44K*a*–1 formed of a foamed polyurethane having an elasticity and a surface layer 44K*a*–2, that is made of a material having a low frictional resistance covering the substrate 44K*a*–1. Further, the sealing portion 44K*a* is configured to contact a part of the surface of the two end portions of the developing roller 41K to which the magnet 41K*b* does not extend, namely, the areas indicated by a character R in FIG. 11A. In addition, the developing doctor 44K is provided inside the developing device 420K adjacent to the opening thereof, and so as to be positioned upstream of the opening of the developing device 420K in a rotating direction of the developing roller 41K (see FIG. 2).

At the rear side of the developing doctor 44K, which is to the rear of the surface of FIG. 11A, and upstream of the developing doctor 44K in the rotating direction of the developing roller 41K, a magnetizable member 60K is disposed such that the distal edge thereof is positioned more distantly from the surface of the developing roller 41K than a distal edge portion of the developing doctor 44K.

In FIGS. 11A and 11B, developer flowing into each of the circumferential surfaces adjacent the ends of the developing roller 41K or outside of the two ends thereof due to rotational movement of the rotary developing apparatus 420 (not shown in FIGS. 11A and 11B) is controlled so as not to be conveyed to the opening of the developing device 420K (see FIG. 2) even though the developing roller 41K is rotated. This is because the developer is stopped by the sealing portion 44K*a* of the developing doctor 44K. More in detail, the sealing portion 44K*a* stops the developer from flowing around the circumferential surfaces adjacent the ends of the developing roller 41K, or outside of the ends, and so to the opening of the developing device 420K. By thus stopping the developer, the developer that flows around the circumferential surface adjacent to the two end parts of the developing roller 41K, or the outside of the two end parts of the developing roller 41K, is not conveyed to the opening of the developing device 420K and the developing station when the developing roller 41K is rotated.

Furthermore, because the substrate 44K*a*–1 of the developing doctor 44K can deform to accommodate vibrations or the like of the developing roller 41K, stresses in the developing roller 41K due to the pressure of the sealing portion 44K*a* contacting the surface of the two end portions of the developing roller 41K is decreased. Further, because the surface layer 44K*a*–2 of the developing doctor 44K is made of the material having low frictional resistance, the frictional resistance caused between the developing roller 41K and the surface layer 44K*a*–2 is decreased and the torque required for the driving device to drive the developing roller 41K is decreased.

Furthermore, because the distal edge portion of the magnetizable member 60K is positioned farther from the surface of the developing roller 41K than that of the developing doctor 44K, the magnetic force applied to the developer on the developing roller 41K is decreased as in the color copying machine of the first embodiment. Therefore, frictional charging operation for the developer can be accelerated by applying magnetic force of a strength that does not apply excessive stress to the developer on the developing roller 41K.

Figure 12:
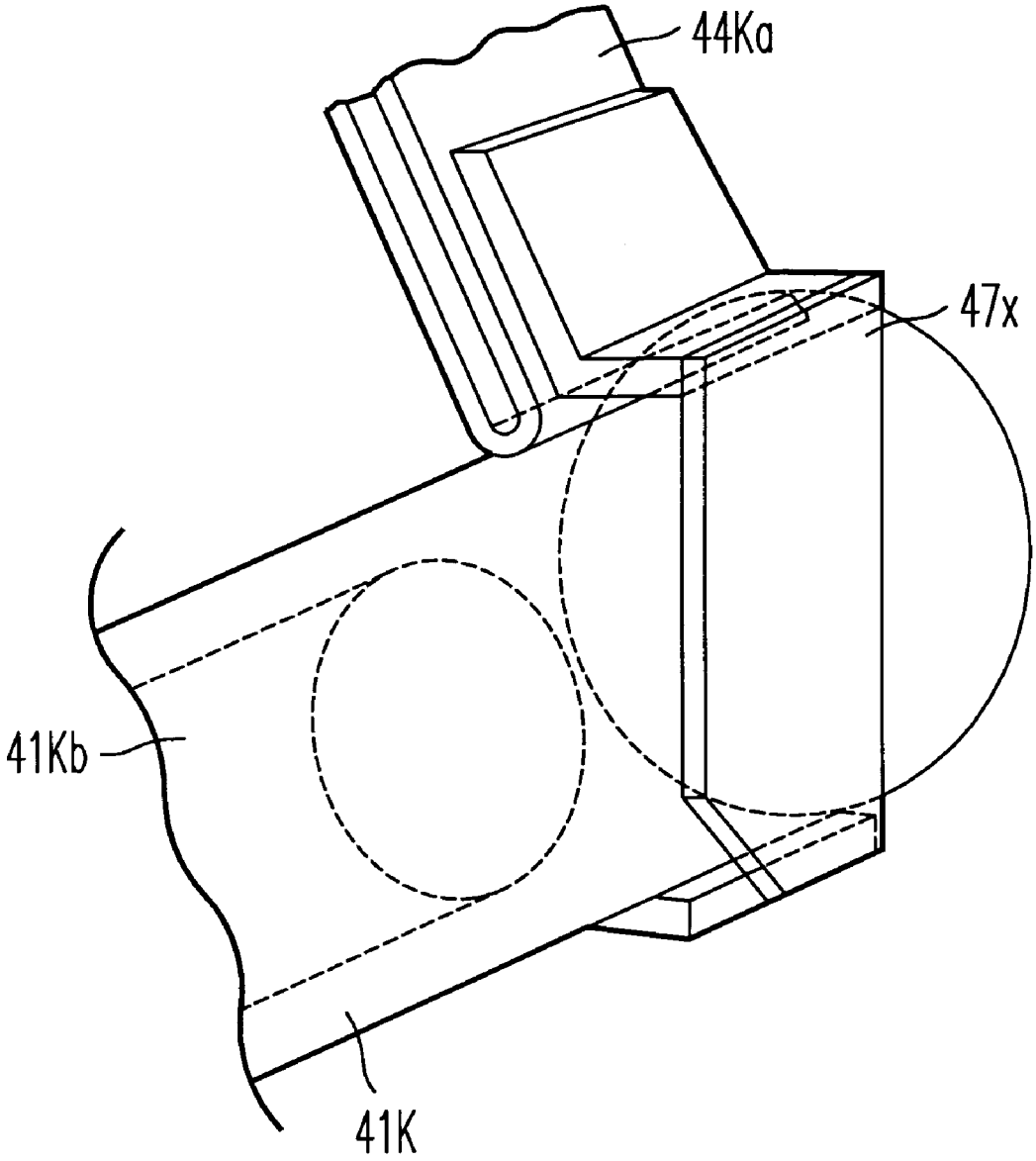
FIG. 12 is a perspective view of an end portion of the developing roller of FIG. 11B.

FIG. 12 is a perspective view illustrating the end portions E and G of the developing roller 41K and the sealing portion 44K*a*. In FIG. 12, a numeral 47*x* is a side seal mounted at two ends of the aforementioned opening of the developing device casing 47K. In the developing device of the conventional image forming apparatus including such a side seal, toner which has flowed into the adjoining portion of two ends of the developing roller 41K is sandwiched between the side seal and the developing roller, and so the side seal sometimes is expanded in a direction towards the photoconductive drum. In addition, the torque required for driving the developing roller is accordingly increased and shortcomings such as heating and melting of the toner by friction of the side seal with the photoconductive drum has occurred. On the contrary, in the color copying machine of the second embodiment, the developer which has flowed into the circumferential surface adjoining two ends of the developing roller 41K or outside thereof can be controlled so as not to be conveyed to the opening of the developing device 420K, and there is no possibility of causing expansion of the side seal.

Figure 3:
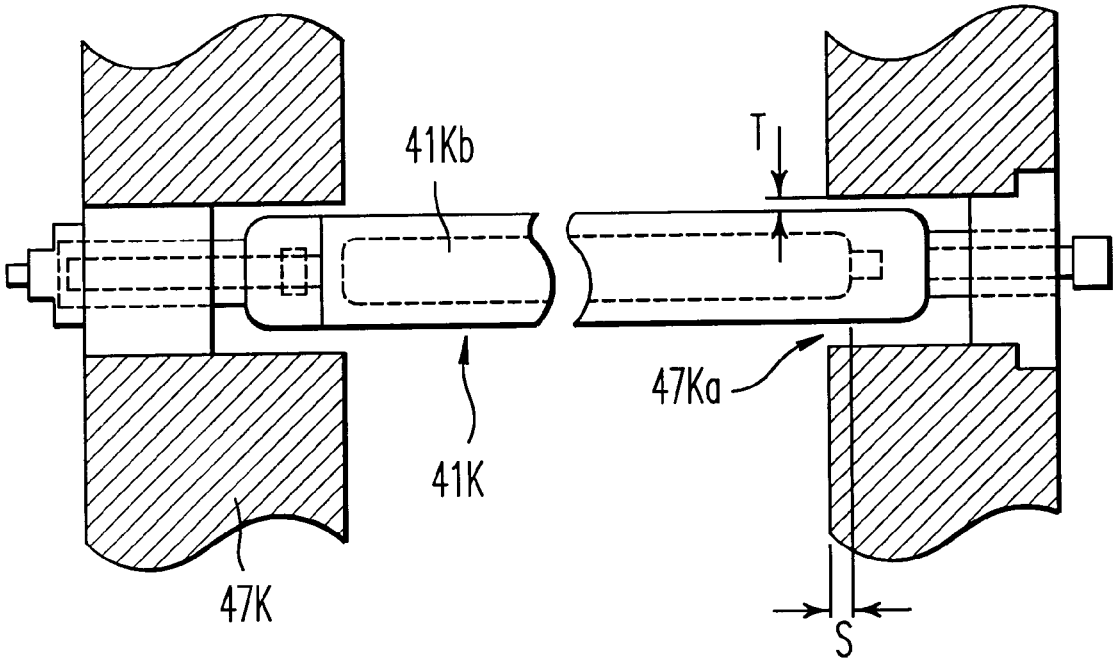
FIG. 3 is an illustration of the developing devices of the rotary roller and the bearing portions of the developing casing.

FIG. 3 is an illustration showing the bearing portions of the developing roller 41K and the developing device casing 47K. The developing doctor 44K is omitted for the convenience of illustration in FIG. 3. As illustrated in FIG. 3, the developing roller 41K is provided such that end parts of the developing roller 41K are located inside of the roller supporting portions 47K*a* of the developing device casing 47K. In this embodiment, the developing roller 41K is positioned such that the end surface of the magnet 41K*b* in the developing roller 41K is located within the developing device casing 47K by a distance "S". The distance S is 1.0 mm in this embodiment. Furthermore, the distance between the surface of the developing roller 41K and an internal surface of the roller supporting portions 47K*a* indicated by a character "T" in FIG. 3, is also 1.0 mm.

By thus setting the distances T and S, the amount of developer that flows into the roller supporting portions 47K*a* and conveyed to the aforementioned opening of the developing device casing 47K is decreased. As a result, the amount of developer conveyed to the developing station from the roller supporting portions 47K*a* is decreased. In addition, the friction of the developer in the roller supporting portions 47K*a* is decreased. It has been experimentally found that when the distance T in FIG. 3 is set to about 0.5 mm to 2.0 mm, developer flowing into the roller supporting portions 47K*a* and being conveyed to the aforementioned opening can be decreased and thereby frictional heat of the developer at the roller supporting portions 47K*a* can be decreased.

In the above-description, although only the configuration of the developing device 420K is explained in each of the embodiments, the developing device 420C, 420M and 420Y can be configured in substantially the same manner as in the developing device 420K. Furthermore, although a two-component developer composed of magnetizable carrier and toner is used in each of the two embodiments, a one-component magnetizable toner can also be used.

Moreover, in each of the embodiments, the rotary developing apparatus including a plurality of developing devices disposed around the rotational shaft is used. However, the present invention can also be applied to a single developing apparatus for developing a latent image using a single color toner.

Numerous modifications and variations of the present invention are possible in light of the above teachings. It is therefore to be understood that within the scope of the appended claims, the invention may be practiced otherwise than as specifically described herein.

This application is based on Japanese patent applications JPAP10-225302 filed in the Japanese Patent Office on Jul. 24, 1998, JPAP10-126868 filed on Apr. 20, 1998, and JPAP11-046109 filed on Feb. 24, 1999, the entire contents of which are hereby incorporated by reference.

What is claimed is:

1. An image forming apparatus, comprising:

an image bearing member; and a developing device positioned to supply a developer to a developing position of the image bearing member, to develop a latent image on a surface of the image bearing member, wherein the developing device includes:

a developing device casing;

a rotatable developer bearing member in the developing device casing and having a magnet therein, the developer bearing member being so positioned in the developing device that upon rotation of the developer bearing member, the developer bearing member bears developer on a surface thereof by a magnetic force of the magnet and carries the developer towards the developing position;

a limiting member made of a non-magnetizable material and positioned facing the developer bearing member so as to limit a thickness of a layer of the developer borne on the developer bearing member; and a magnetizable member having a protruding portion positioned to face a part of the developer bearing member that does not have the magnet therein, and a recessed part positioned to face a part of the developer bearing member that has the magnet therein, the magnetizable member being disposed upstream of the limiting member in a developer conveying direction of the developer bearing member, wherein the protruding portion is nearer to the surface of the developer bearing member than is the limiting member and the recessed part is more distant from the surface of the developer bearing member than is the limiting member.

2. The image forming apparatus according to claim 1, wherein, the limiting member and the magnetizable member are arranged such:

$$c \leqq a - 0.1 \text{ mm}$$

wherein a is a distance between a distal edge portion of the limiting member and the surface of the developer bearing member, and c is a distance between the protruding portion of the magnetizable member and the surface of the developer bearing member.

3. The image forming apparatus according to claim 1, wherein, a step portion connecting the protruding portion to the recessed part is tapered, and wherein the step portion faces a part of the developer bearing member having an end portion of the magnet therein.

4. The image forming apparatus according to claim 1, wherein the developing device develops the latent image formed on the image bearing member by rotating a plurality of developing devices disposed around a rotating shaft.

5. The image forming apparatus according to claim 1, wherein:

$$\text{distance } b \geqq \text{distance } a + 0.3 \text{ mm},$$

wherein the developer bearing member is a developing roller and the limiting member is a developing doctor, and wherein a is the distance between the outer surface of the developing roller and a distal edge portion of the developing doctor, and b is the distance between the outer surface of the developing roller and a distal edge portion of the recessed part of the magnetizable member.

6. The image forming apparatus according to claim 1, wherein:

$$\text{distance } c \leqq \text{distance } a - 0.1 \text{ mm},$$

wherein the developer bearing member is a developing roller and the limiting member is a developing doctor, and wherein a is the distance between the outer surface of the developing roller and a distal edge portion of the developing doctor, and c is a distance between the outer surface of the developing roller and a distal edge portion of the protruding portion of the magnetizable member.

7. An image forming apparatus, comprising:

an image bearing member; and a developing device positioned to supply a developer to a developing position of the image bearing member, to develop a latent image on a surface of the image bearing member, wherein the developing device includes:

a developing device casing;

a developer bearing member in the developing device casing and having a magnet therein, the developer bearing member being so positioned in the developing device that the developer bearing member can bear developer on a surface thereof by a magnetic force of the magnet and carry the developer towards the developing position;

a limiting member made of a non-magnetizable material and positioned facing the developer bearing member so as to limit a thickness of a layer of the developer borne on the developer bearing member;

a magnetizable member having a protruding portion positioned to face a part of the developer bearing member that does not have the magnet therein, and a recessed part positioned to face a part of the developer bearing member that has the magnet therein, the magnetizable member being disposed upstream of the limiting member in a developer conveying direction of the developer bearing member, wherein the protruding portion is nearer to the surface of the developer bearing member than is the limiting member and the recessed part is more distant from the surface of the developer bearing member than is the limiting member; and a sealing member that contacts a part of the surface of the developer bearing member not having the magnet therein, the sealing member being provided near longitudinal ends of the limiting member.

8. The image forming apparatus according to claim 7, wherein the sealing member includes at least a substrate, and a surface layer that contacts the surface of the developer bearing member, and wherein the substrate is made of an elastic material and the surface layer is made of a material having a low frictional resistance.

9. An image forming apparatus, comprising:

an image bearing member; and a developing device positioned to supply a developer to a developing position of the image bearing member, to develop a latent image on a surface of the image bearing member, wherein the developing device includes:

a developing device casing;

a rotatable developer bearing member in the developing device casing and having a magnet, the developer bearing member being so positioned in the developing device that upon rotation of the developer bearing member, the developer bearing member bears developer on a surface thereof by a magnetic force of the magnet and carries the developer towards the developing position;

a limiting member made of a non-magnetizable material and positioned facing the developer bearing member so as to limit a thickness of a layer of the developer borne on the developer bearing member; and a magnetizable member having a protruding portion positioned to face a part of the developer bearing member that does not have the magnet, and a recessed part positioned to face a part of the developer bearing member that has the magnet, the magnetizable member being disposed upstream of the limiting member in a developer conveying direction of the developer bearing member, wherein the protruding portion is nearer to the surface of the developer bearing member than is the limiting member and the recessed part is more distant from the surface of the developer bearing member than is the limiting member, and wherein an end of the developer bearing member including two or more poles of the magnet is positioned inside one of the walls of the developing device casing such that end surfaces of the magnet are positioned inside of the one of the walls of the developing device casing by about 0.5 mm to 2.0 mm.

10. The image forming apparatus according to claim 9, wherein a distance between an inner surface of the one of the walls of the developing device casing and a surface of the developer bearing member inside the one of the walls of the developing device casing is about 0.5 mm to 2.0 mm.

* * * * *